United States Patent [19]

Konijn

[11] 4,163,330

[45] Aug. 7, 1979

[54] DREDGE CUTTER HEAD HAVING A VOLUTE COMPARTMENT

[76] Inventor: Nicolaas G. Konijn, Zuidspierdijkerweg, Berkhout, Netherlands

[21] Appl. No.: 806,504

[22] Filed: Jun. 14, 1977

[30] Foreign Application Priority Data

Jun. 23, 1976 [NL] Netherlands ..... 7606804

[51] Int. Cl.[2] ..... E02F 3/92

[52] U.S. Cl. ..... 37/64; 15/384; 15/385

[58] Field of Search ..... 37/64–67, 37/58, 92, 93; 15/385, 384; 56/320.2

[56] References Cited

U.S. PATENT DOCUMENTS

| | | | |
|---|---|---|---|
| 471,108 | 3/1892 | Duryee | 37/58 |
| 532,183 | 1/1895 | Pike | 37/58 UX |
| 890,764 | 6/1908 | Geare | 37/64 |
| 939,227 | 11/1909 | Diehl | 37/64 |
| 1,093,820 | 4/1914 | Beach | 15/385 X |
| 1,106,038 | 8/1914 | Frühling | 37/66 |
| 1,262,460 | 4/1918 | Dawson | 37/64 X |
| 1,497,360 | 6/1924 | Dawson et al. | 37/65 |
| 3,148,464 | 9/1964 | Jones | 37/67 |
| 3,321,787 | 5/1967 | Myers | 15/1.7 |
| 3,436,788 | 4/1969 | Tamny | 15/385 X |
| 3,601,960 | 8/1971 | Buechler | 56/320.2 |
| 3,877,159 | 4/1975 | Boomstra | 37/64 |
| 4,052,801 | 10/1977 | Smith | 37/64 |

FOREIGN PATENT DOCUMENTS

| | | | |
|---|---|---|---|
| 92978 | 12/1959 | Netherlands | 37/67 |
| 287851 | 2/1965 | Netherlands | 37/65 |

*Primary Examiner*—Clifford D. Crowder

*Attorney, Agent, or Firm*—Haseltine, Lake & Waters

[57] ABSTRACT

An apparatus for disintegrating and removing layers of earth, especially under water, comprising a housing in which at least one volute compartment is formed, which is open on the underside and which accommodates a rotor which comprises disintegrators and which is rotatable about an axis that is at least substantially perpendicular to a plane through the lower edge of the compartment. The rotor is coupled to a drive mechanism, the volute compartment being connected near its throat to a discharge system. The housing may be suspended from a moving device.

29 Claims, 4 Drawing Figures

DREDGE CUTTER HEAD HAVING A VOLUTE COMPARTMENT

BACKGROUND OF THE INVENTION

The invention relates to an apparatus for disintegrating and removing layers of earth, especially under water.

SUMMARY OF THE INVENTION

It is an object of the invention to provide such apparatus which operates with particular efficiency and which has a high capacity.

According to the invention the apparatus is provided with a housing, wherein at least one volute compartment is formed, which is open on the underside and which accommodates a rotor which comprises disintegrators and which is rotatable about an axis that is at least substantially perpendicular to the plane through the lower edge of the compartment, said rotor being coupled to a drive means, the volute compartment being connected near its throat to a discharge means, while the housing may be suspended from a moving device.

The apparatus can be suspended from the ladder of a boat, or from the jib of a hydraulic crane which can be supported on a crane boat or on a tractor. In operation, the apparatus will generally be dragged along behind the boat or the tractor, or pushed along, as the case may be, while describing paths that are, in principle, substantially straight. During operation, the rotor with the disintegrators will produce a highly disintegrating effect on the earth, which earth is exposed to the centrifugal force, passes through the volute compartment and is removed through the discharge means.

The rotor will generally project downwardly outside the volute compartment.

According to an especially favorable embodiment of the invention, the rotor comprises a brush.

The housing may be suspended from the moving device in a position in which the axis of rotation of the rotor lies in a vertical plane extending in the direction of movement of the housing and includes an acute angle to the vertical.

The brush may have the shape of a cup or a dish, and may be provided with a central, downwardly opening cavity.

This cavity inside the brush may accommodate a cutter element which is connected to the brush and which follows the rotary motion of the brush, the cutter element protruding downwardly outside the brush.

This cutter element may comprise a plurality of teeth, which are pivotally suspended at their upper ends.

With this arrangement, the pivot points of the teeth may be located on a circle, the center of which lies on the axis of rotation of the brush.

The teeth are preferably made of resilient material, such as spring steel.

DESCRIPTION OF PREFERRED EMBODIMENTS

Figure 2:
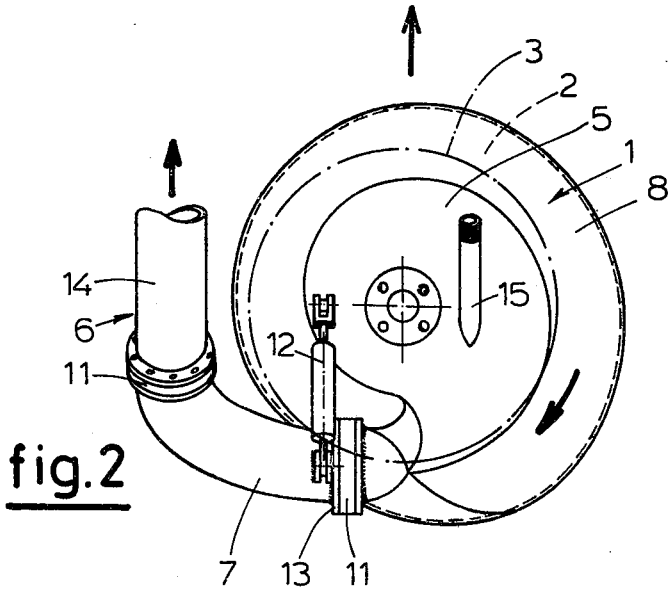
FIG. 2 is a view of the apparatus according to FIG. 1, when viewed in the direction of the arrows II.

The apparatus according to the invention as shown in the drawings serves for disintegrating and removing layers of earth, especially under water.

Figure 1:
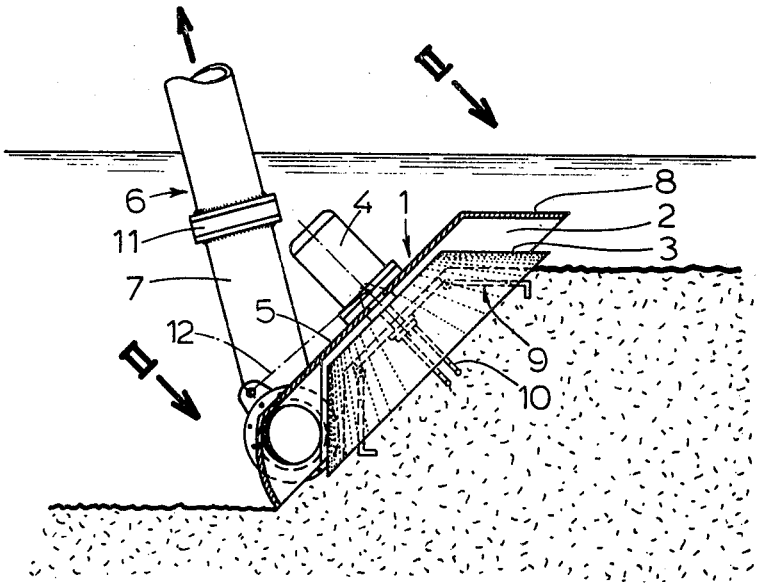
FIG. 1 is a side view partly in section, of a first embodiment of the apparatus according to the invention, comprising one volute compartment and one rotor.

A first embodiment of the apparatus according to the invention is shown in FIGS. 1 and 2. This apparatus comprises a housing 1 in which a volute compartment 2 is formed which is open on the underside. This volute compartment 2 houses a rotor with disintegrators, which rotor comprises a brush 3. The brush 3 is rotatable about an axis which is perpendicular to a plane through the lower edge of the compartment 2. The brush 3 is coupled to a hydromotor 4 which is mounted on a connecting flange on the substantially flat top wall 5 of the housing 1.

The volute compartment 2 is connected near its throat to a discharge line 6. The part 7 of this line, which connects with the volute compartment 2, is substantially tangential to the volute.

The brush 3 projects downwardly outside the volute compartment 2. The brush 3 has the shape of a dish and has a downwardly conically expanding outer surface. As can be seen in FIG. 1, the side wall 8 of the volute compartment 2 is inclined and is adapted to the outer surface of the brush.

As an alternative, the brush 3 can also have the shape of a cup with a cylindrical outer surface.

The brush 3 has a central, downwardly opening cavity which accommodates a cutter element 9. The cutter element 9 is connected to the brush 3 and follows the rotary motion of the brush 3. As shown in FIG. 1, the cutter element 9 protrudes at the lower side outside the brush 3.

The cutter element 9 comprises a plurality of hook-shaped teeth 10 which are pivotally suspended at their upper ends, the pivot points of the teeth 10 being located on a circle, the center of which lies on the axis of rotation of the brush 3. The teeth 10 can be made of resilient material, such as spring steel.

The brush 3 together with the cutter element 9 can be coupled detachably to the hydromotor 4.

The part 7 of the discharge line 6 is connected to the housing 1 by means of a coupling 11—a so-called French flange coupling—which allows a relative rotation about a horizontal axis which is perpendicular to the direction of movement of the housing 1. This coupling can be locked in any angular position. A hydraulically operated cylinder-and-piston assembly 12 is pivotally connected on one side with the top surface 5 of the housing 1, and on its other end with the coupling part 13 which is secured to part 7 of the discharge line, so that the relative position of this part 7 of the discharge line and of the housing 1 can be adjusted by operating the cylinder-and-piston assembly 12.

The discharge line 6 is connected to a pump (not shown).

The apparatus according to FIGS. 1 and 2 can be suspended by its discharge line 6 from the ladder of a boat on which the pump is supported, or from the jib of a hydraulic crane. This crane can be supported on a crane boat or on a tractor, depending on the depth of the water and on the conditions in which the work is to be performed.

Preferably, part 14 of the discharge line connects to part 7 of the discharge line again by means of a coupling similar to the coupling 11, and is secured in such a way that this part 14 of the discharge line is rotatable about its longitudinal axis and can be locked in any desired position. The apparatus according to the invention can thus be controlled and brought into the desired positions as a result of this rotation and by operating the cylinder-and-piston assembly 12. The housing 1 will generally occupy such a position that the axis of rotation of the brush lies in a vertical plane extending in the direction of movement of the housing and includes an acute angle to the vertical. This angle can even be very small. It is furthermore possible to give the apparatus an opposite direction of motion in successive paths, and to reverse this apparatus, as it were, by pivoting the same about a horizontal axis which is at right angles to the direction of motion, during a change-over to a successive path.

In the embodiment shown in the drawing, the angle included by the axis of rotation of the brush 3 and the vertical is adjustable hydraulically, i.e., by means of the cylinder-and-piston assembly 12, but as an alternative it is also possible to use a mechanical setting device for adjusting this angle.

The angular setting of the axis of rotation of the brush 3 with respect to the vertical establishes the depth to which the earth is disintegrated by the co-operating brush 3 and cutter element 9 and is subsequently removed.

In operation, the apparatus will be dragged behind the boat or tractor, or pushed forward, as the case may be, while describing paths which are approximately straight.

Under the joint action of the brush 3 and the cutter element 9, the apparatus according to FIGS. 1 and 2 will produce a particularly strong disintegrating effect upon the earth, while this earth is subjected to the centrifugal force, the loosened earth passing through the volute compartment 2 and being removed through the discharge line 6. Since the disintegrating and centrifugal effect of the brush 3 and of the cutter element 9 also extends over some distance in the earth outside the housing 1, the earth is loosened there as well, thus furthering the subsequent removal of this earth through the volute compartment 2 and the discharge line 6.

The brush 3 is preferably made of hairs of steel wire or polyvinyl chloride having a diameter of 0.5 to 5 millimeters.

When processing loose earth or dredged material, the brush 3 will preferably be equipped with thin, flexible hairs, since they should not stir up the underlying sandy bottom. On the other hand, when cutting into hard earth layers, the brush hairs will preferably be thick and stiff.

If the brush 3 has a conical form as shown in FIG. 1, it can overcome the bottom uneveness more easily than in the case of a brush having the shape of a cylinder. The conical shape allows highly effective cutting into the earth, whereupon the loosened earth is subsequently thrown outwardly by centrifugal force, which furthers the suction action.

The purpose of the cutter element 9 in the hollow center of the brush 3 is to loosen very firm layers of soil by scraping. The loosened earth is thrown outwardly under the action of the centrifugal force, whereafter this earth passes through the volute compartment 2 and reaches the discharge line 6. Pressing the brush 3 and the cutter element 9 with a given force upon the earth causes the cutter teeth 10 and the brush 3 to penetrate into the earth and to loosen it. Further, the brush 3 itself has been found to apply a notable sucking action to the underlying earth.

The volute compartment 2 closely approaches the brush 3 at its throat, so that the rotating mass of earth is separated at this point from the brush 3 and is removed through the discharge line 6. When viewed in the direction of rotation, the volute gradually expands beyond the throat, so that an increasing amount of earth mass can be transported between the brush 3 and the side wall 8 of the volute compartment 2, while the rate of transport nevertheless remains substantially the same.

Although the embodiment shown in FIGS. 1 and 2 operates with a brush 3 as well as with a cutter element 9 accommodated therein, tests have demonstrated that, depending on the circumstances a satisfactory operation may likewise be obtained with the exclusive use of a brush 3 as the rotor.

Instead of the brush 3, the rotor can furthermore consist of a cutter provided with teeth, pins or blades.

In order to allow the apparatus to be applied also for the disintegration and removal of earth layers located under very shallow water (0 to 15 centimeters) or on dry land, a water supply line 15 is connected to the volute compartment 2. The supply of water lowers the concentration of the earth, which is of major importance for removing this soil.

It has been found during tests that if the soil to be removed contains coarse rubbish which might obstruct the apparatus, the brush 3 does not supply this coarse rubbish to the volute compartment 2, but passes over and along this rubbish. This is of great advantage, since damage or jamming of the apparatus is thus prevented. If desired, it is furthermore possible to provide a grid in the volute compartment 2 in front of the mouth of part 7 of the discharge line.

As an alternative to the construction shown in FIG. 1, the housing 1 can be furnished with suspension lugs (not shown) by which it is suspended from the ladder of a boat or from a hydraulic crane. In that case, the suspension mechanism is such that the angle included by the axis of rotation of the brush 3 and the vertical is adjustable, while preferably also creating the possibility of pivoting the housing 1 in a plane which is perpendicular to the plane in which the aforementioned adjusting movement takes place, this pivotal motion being performed about the central longitudinal axis of the housing. Further, it may be important that the suspension mechanism permits an adjustable rotation of the housing 1 by including in the discharge line a coupling— a so-called French flange coupling—which is similar to the coupling 11 and which allows such rotation.

In the embodiment described hereinabove, the pump can be directly connected at its suction side to the housing 1 at the point where, in the embodiment according to FIGS. 1 and 2, the coupling 11 is provided. This pump then has a particularly high capacity, since the suction resistance is at a minimum and the pump is below the water level. This arrangement is especially suitable if the apparatus is to be attached to the jib of a hydraulic crane. However, if the apparatus is to be suspended from the ladder of a boat, the pump will generally be supported on this boat and be connected by a flexible discharge line to the connecting flange.

Figure 3:
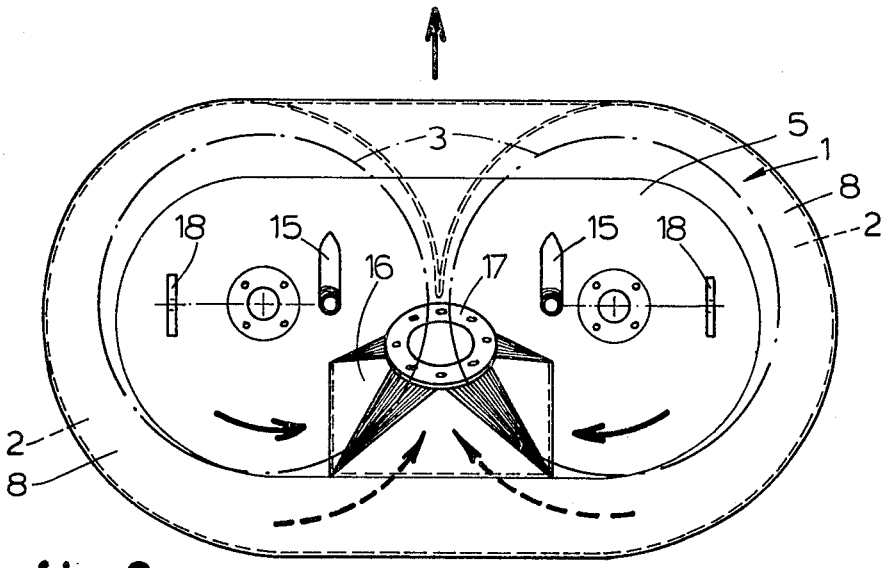
FIG. 3 is a top view of a modified embodiment of the apparatus according to the invention, comprising two volute compartments and two rotors.

FIG. 3 shows a second embodiment of the apparatus according to the invention, with a housing 1 in which two volute compartments 2 are formed, each of which is open on the underside and co-operates with a rotor which comprises a disintegrator means. This rotor can be constructed in the same manner as described hereinabove.

The horizontal line connecting the axes of rotation of the two rotors is at least substantially perpendicular to the direction in which the apparatus is displaced, as shown in FIG. 3.

The two rotors are each coupled to a hydromotor, these hydromotors preferably being connected in series, so that they have the same speed of rotation in operation, which allows a simplified control of the apparatus. When each of the two rotors comprises a brush, the working areas of these brushes will preferably touch each other or even overlap, so that there is no possiblity of a ridge subsisting on the earth surface.

The two volute compartments 2 in the embodiment according to FIG. 3 are connected to a common discharge line. To this end, the top wall 5 of the housing 1 supports a discharge stub 16 which, from its connection to the two volute compartments 2, near the throats thereof, at the top wall 5 of the housing 1, gradually tapers upwardly to a smaller cross section and ends in a connecting flange 17. The pump can again be attached directly at its suction side to this connecting flange 17, or it can be connected thereto by a flexible discharge line.

A water supply line 15 is again connected to each of the volute compartments 2 for supplying additional water when work is performed under very shallow water or on dry land.

Further, the housing 1 is fitted with suspension lugs 18 allowing engagement with the suspension mechanism.

Figure 4:
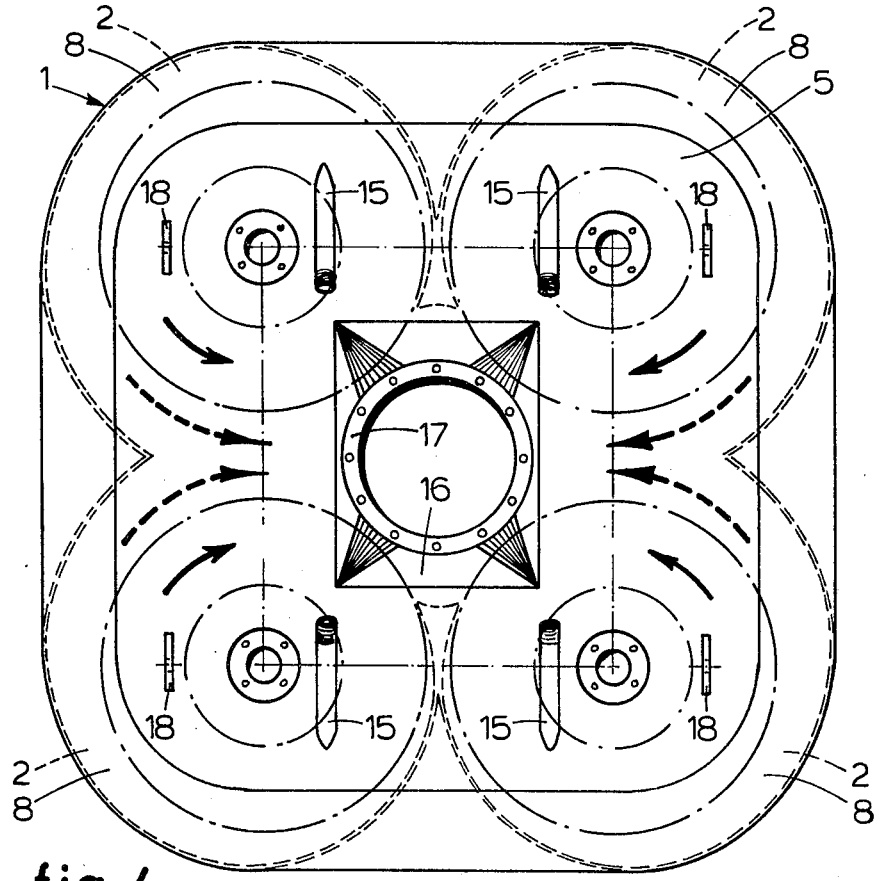
FIG. 4 is a top view of yet another embodiment of the apparatus according to the invention, comprising four volute compartments and four rotors.

FIG. 4 shows a further example of the apparatus according to the invention, with a housing 1 wherein four volute compartments 2 are formed which are open on the underside and each of which co-operates with a rotor comprising a disintegrator means. This rotor can again be constructed in the same manner as described hereinabove with reference to FIGS. 1 and 2.

As shown in FIG. 4, the axes of rotation of the rotors substantially form the upright edges of a cube, so that the apparatus is entirely symmetric. If the four rotors each comprise a brush, the working areas of adjacent brushes will again preferably touch each other or overlap.

The four volute compartments are again connected, near the throats, to a common central discharge means, which in the embodiment according to FIG. 4 is constituted by a discharge stub 16 that ends in a connecting flange 17 and that is constructed in a similar manner as the stub 16 shown in FIG. 3. Water supply lines 15 are connected to each of the volute compartments 2, and suspension lugs 18 are again fitted on the top wall 5 of the housing 1.

The embodiment according to FIG. 3 with two volute compartments 2 and two rotors and particularly the embodiment according to FIG. 4 with four volute compartments 2 and four rotors excel in a particularly high capacity. It is of course possible to construct the apparatus on the same principle with still other numbers of volute compartments 2 and associated rotors.

The invention is not restricted to the examples shown in the drawings, which may be varied in various manners within the scope of the appended claims.

I claim:

1. An apparatus for disintegrating and removing layers of earth, especially under water, comprising a housing in which at least one volute compartment is formed, which has an open lower edge, a rotor mounted in said compartment, and projecting downwardly outside the volute compartment, said rotor being rotatable about an axis which is substantially perpendicular to a plane through the lower edge of the compartment, drive means coupled to said rotor, said rotor comprising a brush in the shape of a cup provided with a central, downwardly opening cavity, a cutter element in said cavity and connected to the brush to follow the rotary motion of the brush, said cutter element protruding downwardly outside the brush, said volute compartment having a throat, discharge means connected to said compartment near said throat and means on said housing for suspension thereof from a moving device.

2. An apparatus as claimed in claim 1, wherein the housing comprises two said compartments each supporting one said rotor and arranged so that a horizontal line connecting the axes of rotation of the two rotors is at least substantially perpendicular to the direction of movement of the housing.

3. An apparatus as claimed in claim 1, wherein the discharge means comprises a common discharge line connected to the two compartments.

4. An apparatus as claimed in claim 1, wherein the housing comprises four compartments each supporting a respective said rotor, the axes of rotation of the four rotors substantially forming the upright edges of a cube.

5. An apparatus as claimed in claim 1, wherein the housing comprises four volute compartments each supporting a respective said rotor, the axes of rotation of the four rotors substantially forming the upright edges of a cube.

6. An apparatus as claimed in claim 5, wherein the discharge means comprises a common discharge line connected to the four compartments.

7. An apparatus as claimed in claim 5, wherein the discharge means comprises a common discharge line connected to the four volute compartments.

8. An apparatus as claimed in claim 1, wherein the housing comprises two volute compartments each supporting one said rotor and arranged so that a horizontal line connecting the axes of rotation of the two rotors is at least substantially perpendicular to the direction of movement of the housing.

9. An apparatus as claimed in claim 8, wherein said discharge means comprises a discharge stub fitted on the top wall of the housing and connected to the compartments, near the throats thereof, said discharge stub gradually tapering upwardly to a smaller cross section and ending in a connecting flange.

10. An apparatus as claimed in claim 8, wherein said discharge means comprises a discharge stub fitted on the top wall of the housing and connected to the volute compartments, near the throats thereof, said discharge stub gradually tapering upwardly to a smaller cross section and ending in a connecting flange.

11. Apparatus as claimed in claim 10, wherein said discharge means further comprises a pump attached directly to the connecting flange.

12. An apparatus as claimed in claim 1, wherein the drive means comprises a hydromotor which is supported on a substantially flat top surface of the housing.

13. An apparatus as claimed in claim 1, wherein the housing is suspended from the moving device in a position wherein the axis of rotation of the rotor lies in a vertical plane extending in the direction of movement of the housing and includes an acute angle to the vertical.

14. An apparatus as claimed in claim 1, wherein the cutter is provided with teeth.

15. An apparatus as claimed in claim 1, wherein the cutter is provided with pins.

16. An apparatus as claimed in claim 1, wherein the brush has a downwardly conically expanding outer surface.

17. An apparatus as claimed in claim 1, wherein the cutter element comprises a plurality of teeth which are pivotally suspended at their upper ends.

18. An apparatus as claimed in claim 17, wherein the pivot points of the teeth are located on a circle, the center of which lies on the axis of rotation of the brush.

19. An apparatus as claimed in claim 18, wherein the teeth are made of resilient material.

20. An apparatus as claimed in claim 1, wherein the discharge means comprises a discharge line which is connected to the suction side of a pump.

21. An apparatus as claimed in claim 20, wherein the part of the discharge line which connects to the volute compartment is at least substantially tangential to the volute.

22. An apparatus as claimed in claim 1, comprising water supply means opening into the volute compartment.

23. An apparatus as claimed in claim 1, wherein the suspension means comprises suspension lugs fitted on the top surface of the housing.

24. An apparatus as claimed in claim 1, wherein the discharge means comprises a common discharge line connected to the two volute compartments.

25. An apparatus as claimed in claim 1, wherein the brush, together with the cutter element, is coupled detachably to the drive means.

26. An apparatus for disintegrating and removing layers of earth, especially under water, comprising a housing in which at least one compartment is formed which has an open lower edge, a rotor rotatably supported in said compartment and projecting downwardly outside said compartment, said rotor being rotatable about an axis which is substantially perpendicular to a plane through the lower edge of the compartment, drive means coupled to said rotor, said rotor comprising a brush in the shape of a cup provided with a central downwardly open cavity, a cutter element in said cavity connected to said brush to follow the rotary motion of the brush, said cutter element protruding downwardly outside the brush, discharge means connected to said compartment, and means for suspending said housing from a moving device.

27. An apparatus as claimed in claim 26, comprising water supply means opening into the compartment.

28. An apparatus for disintegrating and removing layers of earth, especially under water, comprising a housing in which at least one volute compartment is formed which has a lower edge and is entirely open at said lower edge, said volute compartment having a throat, disintegrator rotor means rotatably supported in said volute compartment and projecting downwardly outside said compartment, said rotor means being rotatable about an axis which is substantially perpendicular to a plane through the lower edge of the compartment, drive means coupled to said rotor means, said rotor means comprising a brush in the shape of a cup provided with a central downwardly open cavity, discharge means comprising a pump supported outside said housing and having a suction side connected to said volute compartment in the vicinity of said throat and means for suspending said housing from a moving device.

29. An apparatus as claimed in claim 28, wherein said disintegrator rotor means comprises cutter means in said central cavity of the brush.

* * * * *